US008362383B2

(12) United States Patent
Yang et al.

(10) Patent No.: US 8,362,383 B2
(45) Date of Patent: Jan. 29, 2013

(54) MULTI-POSITION PUSH SWITCH

(75) Inventors: Xin Yang, Shenzhen (CN); Wei Wu, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 364 days.

(21) Appl. No.: 12/886,583

(22) Filed: Sep. 21, 2010

(65) Prior Publication Data

US 2011/0120842 A1 May 26, 2011

(30) Foreign Application Priority Data

Nov. 20, 2009 (CN) ..... 2009 1 0310121

(51) Int. Cl.
*H01H 19/62* (2006.01)

(52) U.S. Cl. ..... 200/527; 200/526; 200/529

(58) Field of Classification Search ..... 200/520, 200/523, 526–529, 17 B
See application file for complete search history.

(56) References Cited

U.S. PATENT DOCUMENTS 5,001,316 A * 3/1991 Salaman ..... 200/527
6,809,281 B2 * 10/2004 Miki ..... 200/529

* cited by examiner

*Primary Examiner* — Renee Luebke
*Assistant Examiner* — Lheiren Mae Caroc
(74) *Attorney, Agent, or Firm* — Altis Law Group, Inc.

(57) ABSTRACT

A multi-position switch includes a base and a cover. The base and the cover form a receiving space having a lateral surface. The cover defines a through hole and includes a bottom surface and a number of ratchet teeth protruding from the bottom surface and arranged around the through hole. A number of positive contacts and a negative contact are arranged on the lateral surface. The button includes a button body having a side surface and a number of protrusions protruding from the side surface. The button body passes through the through hole and is external to the cover. Each protrusion is located between two neighboring ratchet teeth and has a sloping end. A conductive member is arranged under the button body and includes a conductive rod having two ends configured for respectively contacting one of the positive contacts and the negative contact.

6 Claims, 7 Drawing Sheets

MULTI-POSITION PUSH SWITCH

BACKGROUND

1. Technical Field

The present disclosure relates to switches and, particularly, to a multi-position switch.

2. Description of Related Art

In an electrical appliance such as an oven, a multi-position rotary selector with seven positions may be used, and the seven positions of the rotary selector switch might include off, convection baking, baking, cleaning, conventional cooking, broiling and convection broiling. Although the conventional rotary switches satisfy basic requirements, a new multi-position switch is still needed.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure will now be described in detail below, with reference to the accompanying drawings.

Figure 1:
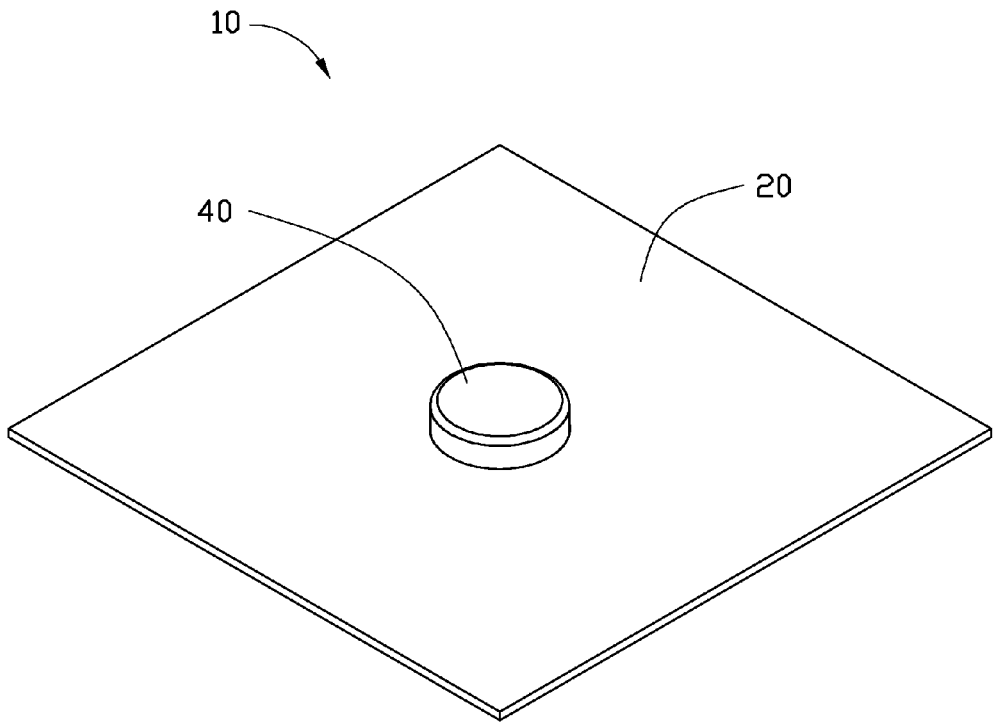
FIG. 1 is an isometric view of a multi-position switch in accordance with one embodiment.
Figure 2:
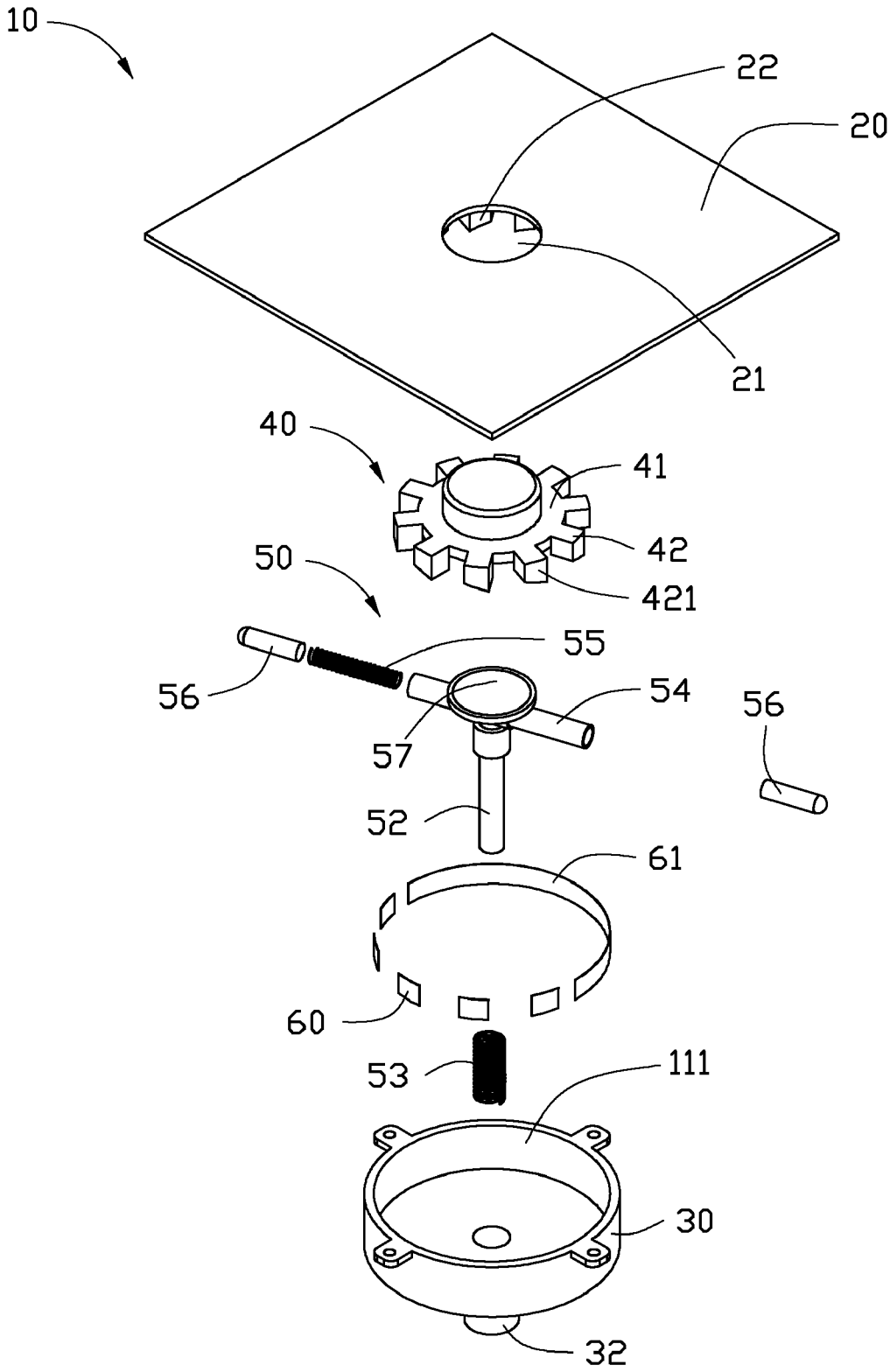
FIG. 2 is an isometric, exploded view of the multi-position switch of FIG. 1.
Figure 3:
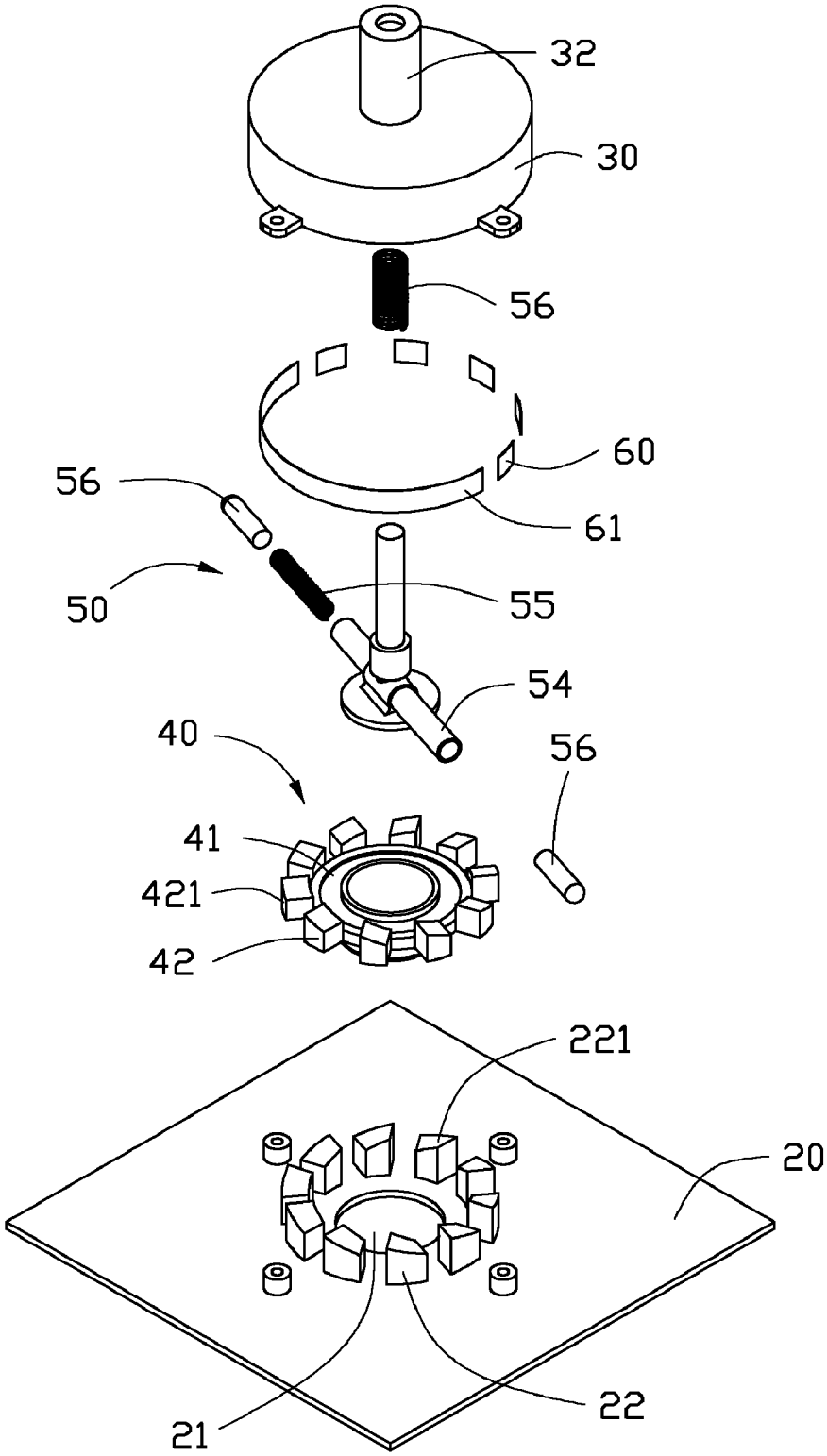
FIG. 3 is another isometric exploded view of the multi-position switch of FIG. 1, viewed from another viewpoint.

Referring to FIGS. 1-3, a multi-position switch 10 includes a base 30 and a cover 20. The cover 20 defines a through hole 21 and includes a number of ratchet teeth 22 on its bottom. The ratchet teeth 22 are arranged around the through hole 21 and are evenly spaced from each other. Each ratchet tooth 22 includes a sloping end 221.

Figure 4:
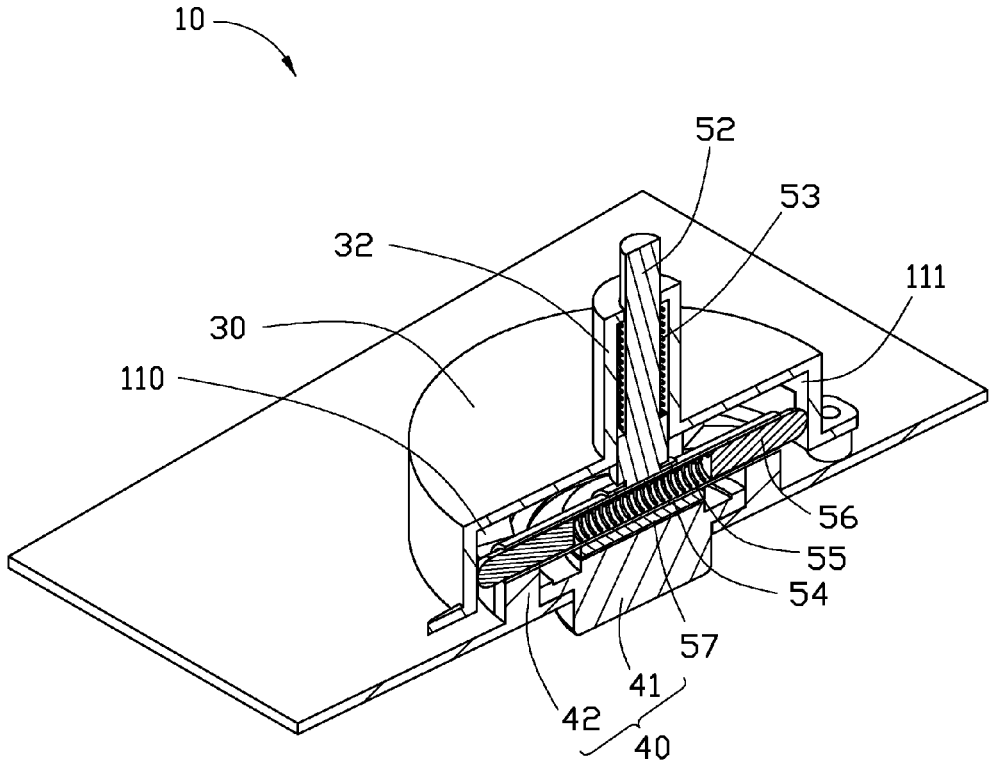
FIG. 4 is a cutaway view of the multi-position switch of FIG. 3.

The base 30 is a shallow cup and can be fixed to the bottom of the cover 20 by screws (not shown). The base 30 includes a tubular portion 32 protruding from its bottom. The cover 20 and the base 30 define a closed receiving chamber 110 (see FIG. 4). The receiving chamber 110 includes a lateral surface 111. In the embodiment, the lateral surface 111 is the internal lateral surface of the base 30.

Figure 5:
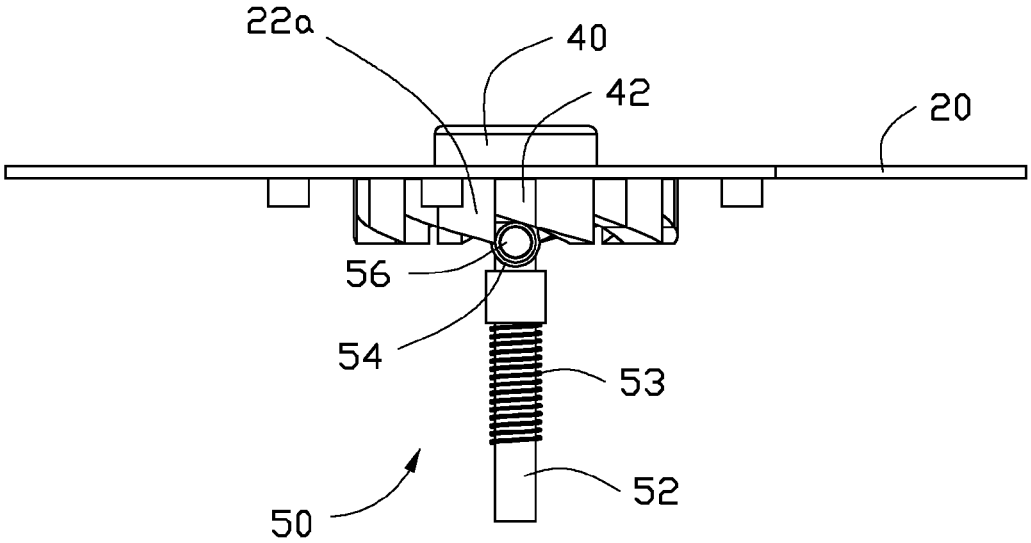
FIG. 5 shows the multi-position switch of FIG. 1 in a normal state.
Figure 6:
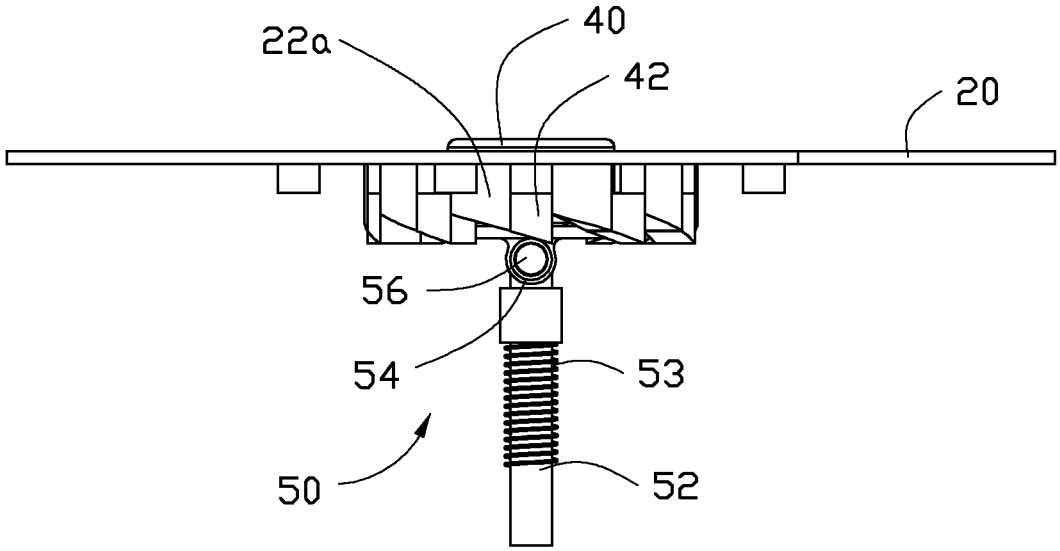
FIG. 6 is similar to FIG. 5, but showing the multi-position switch of FIG. 1 in a depressed stated.

The switch 10 also includes a button 40, a conductive rod 50, a number of internal positive contacts 60, and a common internal negative contact 61. The button 40 includes a button body 41 and a number of protrusions 42 protruding from the lateral surface of the button body 41. The button body 41 extends through the through hole 21 of the cover 20 and is exposed from the cover 20. Each protrusion 42 includes a sloping end 421. Referring to FIGS. 5-6, each protrusion 42 is located between two neighboring ratchet teeth 22 of the cover 20.

The conductive rod 50 is arranged under the button 40 and is used to make a connection between the contact 61 and one of the contacts 60. In the embodiment, the rod 50 includes a sleeve 54, a resilient member 55 received in the sleeve 54, and two sub-rods 56. The two sub-rods 56 are connected by the resilient member 55 and are partly received in the sleeve 54. The rod 50 further includes a sliding shaft 52 and a disk 57 at opposite sides of the sleeve 54. The shaft 52 passes through the tubular portion 32. The disk 57 stays in contact with the bottom of the button body 41. An elastic member 53 is arranged around the shaft 52 and is configured to apply a spring force to the conductive rod 50. The conductive rod 50 can thus be retained in a first position where the sub-rods 56 respectively rest on the sloping ends 421 of two protrusions 42, and abut against two ratchet teeth 22.

Each of the contacts 60 and the contact 61 are electrically connected to one external contact (not shown) that can be connected to a chip of an electronic device (not shown). When the contact 61 and one of the contacts 60 are closed, the chip can identify the closed contacts and notify a main processor (not shown) of the electronic device.

Figure 7:
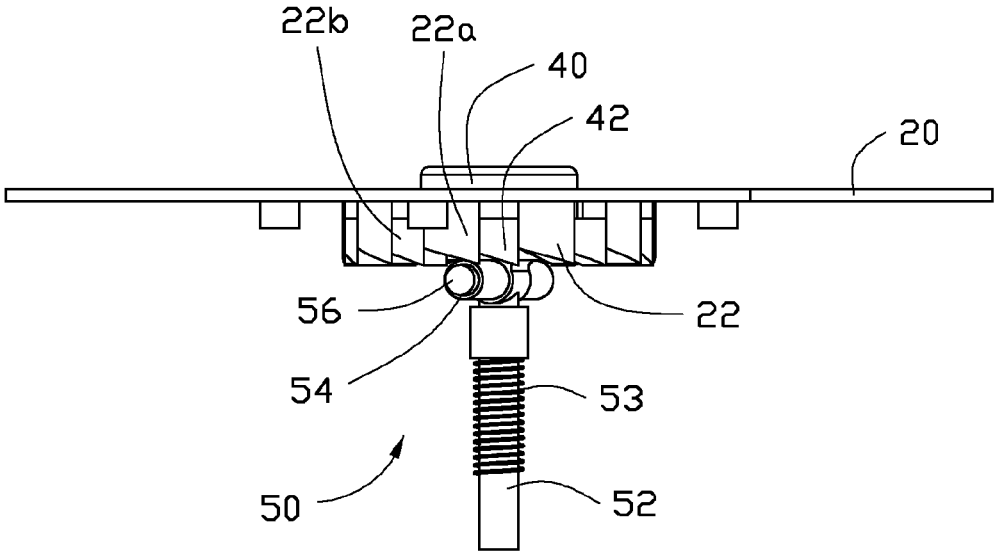
FIG. 7 is similar to FIG. 6, but showing the depressed multi-position switch rotated to a different position.

Referring to FIG. 5, normally, the button 40 projects out of the cover 20 and the conductive rod 50 abuts against two ratchet teeth 22 (hereinafter referred as teeth 22*a*). Referring to FIG. 6, when the button 40 is depressed, the conductive rod 50 is pushed. After the sloping end 421 under the conductive rod 50 is substantially flush with the sloping end 221 of the ratchet tooth 22*a*, the rod 50 is urged by the elastic member 53 to move along the sloping ends 421 and 221 until abutting against another two ratchet teeth 22 (one not shown, and one shown in FIGS. 6 and 7 and designated 22*b*). After being stopped by the two ratchet teeth 22, the conductive rod 50 completes a connection between a different contact 60 and the contact 61. Accordingly, each time the button 40 is depressed, the conductive rod 50 rotates a predetermined angle breaking a current connection between of the contacts 60 and the contact 61 and forming a new connection with a different one of the contacts 60 and the contact 61.

While various embodiments have been described and illustrated, the disclosure is not to be constructed as being limited thereto. Various modifications can be made to the embodiments by those skilled in the art without departing from the true spirit and scope of the disclosure as defined by the appended claims.

What is claimed is:

1. A multi-position switch comprising:

a base and a cover, the base and the cover defining a receiving chamber, the receiving chamber comprising a lateral surface, the cover defining a through hole, the cover comprising a bottom surface and a plurality of ratchet teeth protruding from the bottom surface and arranged around the through hole, each of the plurality of ratchet teeth comprising a first sloping end;

a plurality of positive contacts and a negative contact arranged on the lateral surface;

a button comprising a button body, the button body comprising a side surface and a plurality of protrusions protruding from the side surface, the button body passing through the through hole and being external to the cover, each of the plurality of protrusions locating between two neighboring ones of the plurality of ratchet teeth and comprising a second sloping end;

a conductive member arranged under the button body and comprising a conductive rod, the conductive rod comprising two ends configured for respectively contacting one of the positive contacts and the negative contact; and an elastic member arranged in the receiving chamber and configured to apply a spring push force to the conductive member in a first position where two ends of the conductive rod abut and rest on two of the plurality of protrusions and abut against two of the plurality of ratchet teeth;

wherein when the button is pushed, the two of the plurality of protrusions move and urge the conductive rod to move, after the conductive rod moves to a second position, two ends of the conductive rod move along the second sloping ends of the two of the plurality of protrusions until reaching another two of the plurality of ratchet teeth.

2. The multi-position switch according to claim 1, wherein the elastic member is a coil spring.

3. The multi-position switch according to claim 2, wherein the conductive rod further comprises a sliding shaft protruding from a lateral surface of the conductive rod, a tubular retaining member protrudes from the base, the sliding shaft passes through the tubular retaining member, the coil spring is arranged around the sliding shaft.

4. The multi-position switch according to claim 1, wherein the conductive rod comprises a first rod, a second rod, and a resilient member for connecting the first rod and the second rod, the resilient member is configured for urging the first rod and the second rod.

5. The multi-position switch according to claim 4, wherein the conductive rod further comprises a retaining sleeve for receiving the resilient member and partly receiving the first rod and the second rod.

6. The multi-position switch according to claim 5, wherein the conductive rod further comprises a disk on the retaining sleeve and stays in contact with the button body.

* * * * *